US009603194B2

(12) United States Patent
Peng

(10) Patent No.: US 9,603,194 B2
(45) Date of Patent: Mar. 21, 2017

(54) TEMPERATURE CONTROLLING HEATING DEVICE

(71) Applicant: Shin-Ping Peng, Taipei (TW)

(72) Inventor: Shin-Ping Peng, Taipei (TW)

( * ) Notice: Subject to any disclaimer, the term of this patent is extended or adjusted under 35 U.S.C. 154(b) by 117 days.

(21) Appl. No.: 14/583,515

(22) Filed: Dec. 26, 2014

(65) Prior Publication Data

US 2016/0050716 A1 Feb. 18, 2016

(30) Foreign Application Priority Data

Aug. 15, 2014 (TW) ..... 103214537 U

(51) Int. Cl.
*H05B 1/02* (2006.01)
*A41D 13/005* (2006.01)

(52) U.S. Cl.
CPC ..... *H05B 1/0272* (2013.01); *A41D 13/0051* (2013.01)

(58) Field of Classification Search
CPC ..... H05B 1/0272; H05B 1/02; H05B 3/342; H05B 3/347; A41D 13/0051
USPC ..... 219/211, 483, 486, 506, 497, 494
See application file for complete search history.

(56) References Cited

U.S. PATENT DOCUMENTS 8,109,982 B2 * 2/2012 Naghavi ..... A61N 2/002 607/108
2012/0318781 A1 * 12/2012 Lavin, Jr. ..... A41D 13/005 219/211
2013/0037531 A1 * 2/2013 Gray ..... H05B 1/0272 219/211
2013/0306614 A1 * 11/2013 Fey, Jr. ..... A41D 1/00 219/211
2014/0353300 A1 * 12/2014 Swiatek ..... H05B 1/0272 219/211
2014/0374402 A1 * 12/2014 Cornelius ..... A61F 9/028 219/211
2015/0060430 A1 * 3/2015 Tsuge ..... H05B 1/0272 219/211
2015/0083705 A1 * 3/2015 Cronn ..... H05B 3/347 219/211
2015/0230524 A1 * 8/2015 Stevens ..... A41D 13/0051 219/211

* cited by examiner

*Primary Examiner* — Mark Paschall
(74) *Attorney, Agent, or Firm* — Cheng-Ju Chiang

(57) ABSTRACT

A temperature controlling heating device, comprising a heating piece, a temperature controlling means, which is electrically connected to the heating piece, including a temperature adjusting element, a temperature displaying element and a microprocessor, wherein the temperature adjusting element and the temperature displaying element are disposed on a surface of the temperature controlling means, the microprocessor is disposed within the temperature controlling means and is electrically connected to the temperature adjusting element, the temperature displaying element and the heating piece, the temperature adjusting element is provided to adjust temperature of the heating piece with the microprocessor in respond to a user's input, and a battery electrically connected to the temperature controlling means and the heating piece to provide electrical power for the temperature controlling means and the heating piece.

9 Claims, 4 Drawing Sheets

TEMPERATURE CONTROLLING HEATING DEVICE

FIELD OF THE INVENTION

The present invention relates to a heating device, and more particularly to a heating device which controls temperature.

BACKGROUND OF THE INVENTION

People tend to wear heavy clothes to keep warm in winter, but wearing heavy clothes could make people feel uncomfortable. Further, heavy clothing storage would result in much inconvenience. Therefore, manufacturers have developed such heat preservation articles as hand warmer packs, etc. to provide heat. However, these articles can merely retain heat in certain body parts apart from inability to control the temperature. Moreover, they can also be used over a very short time period, thereby making them inadequate to provide heat retention efficiency people need.

SUMMARY OF THE INVENTION

The present invention has been made in view of the above circumstances, and an object of the present invention is to provide a temperature heating device to solve the conventional problems.

To achieve the above object, the present invention provides a temperature controlling heating device, comprising: a heating piece; a temperature controlling means and a battery. The heating piece can be made of carbon fiber or alloy fiber. The temperature controlling means electrically connected to the heating piece includes a temperature adjusting element, a temperature displaying element and a microprocessor, wherein the temperature adjusting element and the temperature displaying element are disposed on a surface of the temperature controlling means, the microprocessor is disposed within the temperature controlling means and is electrically connected to the temperature adjusting element, the temperature displaying element and the heating piece, the temperature adjusting element is adjusted by a user to adjust the temperature of the temperature of the heating piece via the microprocessor, and a battery is electrically connected to the temperature controlling means and the heating piece so as to supply power to the temperature controlling means and the heating piece.

According to an embodiment of the present invention, there is provided a temperature controlling heating device further comprising an external temperature controlling means including: an external temperature adjusting element, an external temperature displaying element; an external microprocessor and an external wireless controlling transceiver. The external temperature adjusting element and the external temperature displaying element are disposed on a surface of the external temperature controlling means while the external microprocessor and the external wireless controlling transceiver are disposed within the external temperature controlling means. Further, the external microprocessor is electrically connected to the external temperature adjusting element and the external temperature displaying element; and an external wireless controlling transceiver is electrically connected to the external microprocessor and wirelessly connected to the temperature controlling means to receive or transmit a temperature controlling signal of the external microprocessor.

According to an embodiment of the present invention, the battery can be a dry battery or a lithium battery.

According to an embodiment of the present invention, the battery is disposed within the temperature controlling means.

According to an embodiment of the present invention, the temperature controlling means further includes an external power connecting element for electrically connected to an external power source.

According to an embodiment of the present invention, the external power source is a commercial power source.

According to an embodiment of the present invention, a temperature controlling signal can be a Bluetooth signal, a Wi-Fi signal or a radio frequency signal.

According to an embodiment of the present invention, the external temperature controlling means can be a mobile communication device, and an external temperature adjusting element can be a touch screen element.

According to an embodiment of the present invention, the external temperature adjusting element is a shaking element, which is provided for a user to adjust the temperature of the heating piece by shaking the external temperature adjusting element.

According to an embodiment of the present invention, the heating piece is further provided with a vibrator wirelessly connected to the external wireless controlling transceiver to receive an audio signal from the external temperature controlling means, and the vibrator performs a vibratory action according to the audio signal.

By way of the technical means adopted by the present invention, the heating piece could be disposed within a lining of textiles and the temperature thereof is controlled by the temperature controlling means. A user can adjust the temperature depending on personal needs. Further, the present invention uses the battery as a power source of the heating piece. As long as a replacement battery can continue to heat up, a user is thus provided with better heat retention efficiency and an extended period of use.

DETAILED DESCRIPTION OF THE PREFERRED EMBODIMENTS

To clearly illustrate the object and effect of the present invention, the following description is explained with reference to FIGS. 1, 2, 3 and 4.

Figure 1:
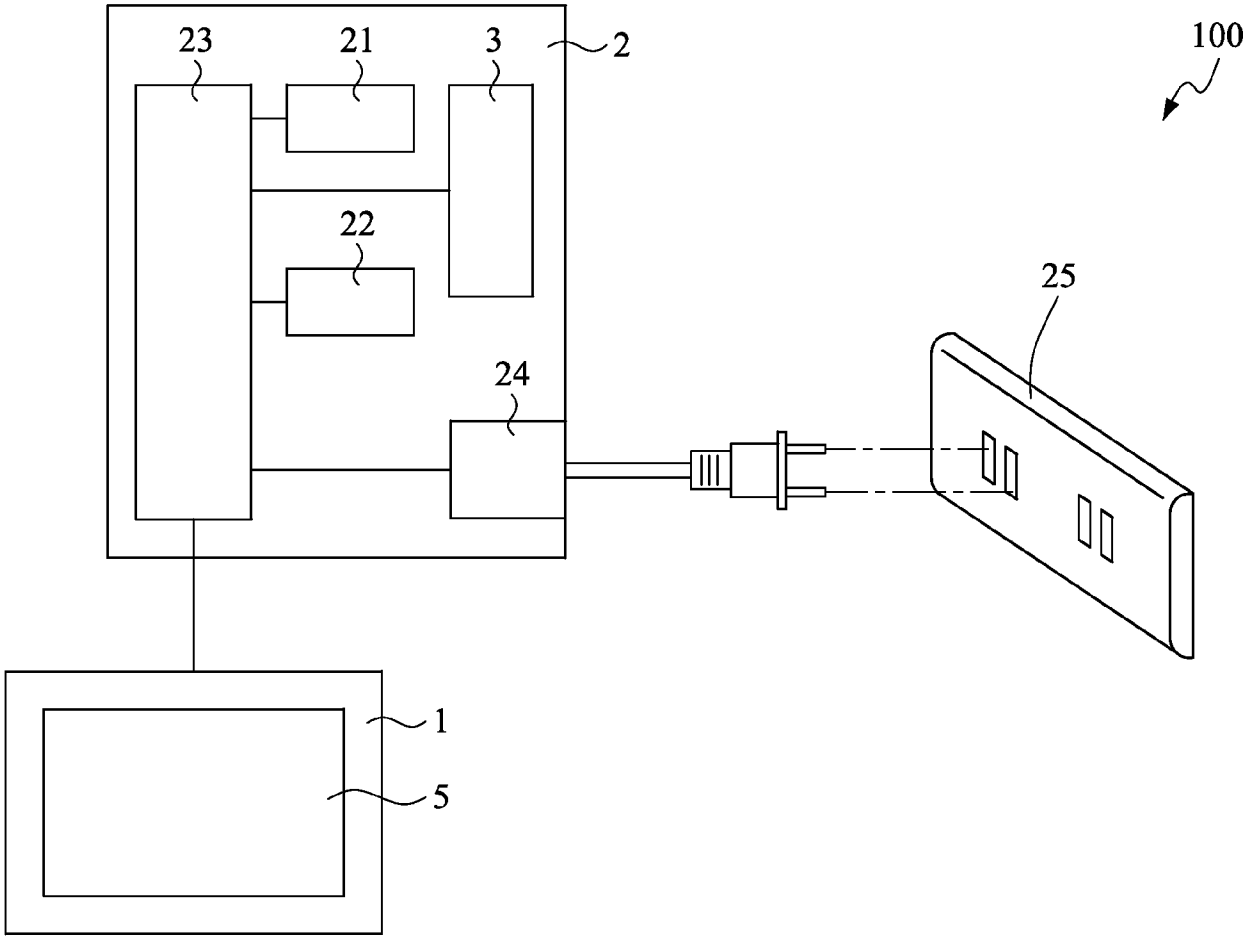
FIG. 1 is a block diagram illustrating a temperature controlling heating device according to a first embodiment of the present invention.

As shown in FIG. 1, the temperature controlling heating device 100 comprises a heating piece 1, a temperature controlling means 2, and a battery 3.

The heating piece 1 can be a heating piece made of carbon fiber or alloy fiber. The heating piece 1 disposed within a fabric O. According to the first embodiment, the heating piece is disposed within a lining of a coat. The fabric O, however, is not limited to a coat. It can also be an upper garment, pants, gloves, socks of a facial mask. The heating piece 1 can also be disposed within linings of the aforementioned fabrics.

As shown in FIG. 1, a temperature controlling member 2 is electrically connected to the heating piece 1 to transmit power to the heating piece 1 and adjust the temperature of the heating piece 1. The temperature controlling member 2 includes a temperature adjusting element 21, a temperature displaying element 22, a temperature sensor and a microprocessor 23. The temperature adjusting element 21 and the temperature displaying element 22 are disposed on the same surface of the temperature controlling means 2. The microprocessor 23 is disposed within the temperature controlling means 2 and is electrically connected to the temperature adjusting element 21, the temperature displaying element 22, the temperature sensor and the heating piece 1. The temperature adjusting element 21 is adjusted by a user to adjust the temperature of the heating piece 1 via the microprocessor 23. In practical operation, the temperature sensor senses the temperature of the heating piece 1, and the temperature displaying element 22 displays the temperature of the heating piece 1 via the microprocessor 23. The user reads the temperature of heating piece 1 from the temperature displaying element 22. When the user considers the temperature is low, the temperature of the heating piece 1 can be adjust through the user controls the temperature adjusting element 21 to transmit a temperature increasing electrical signal to the microprocessor 23. The microprocessor 23 correspondingly controls the battery 3 to increase the current transferred to the heating piece 1 according to the temperature increasing electrical signal transmitted by the temperature adjusting element (21), thereby causing the temperature of the heating piece 1 to reach the temperature desired by the user. When the user considers the temperature is high, the temperature of the heating piece 1 can be adjust through the user controls the temperature adjusting element 21 to transmits a temperature decreasing electrical signal to the microprocessor 23. The microprocessor 23 correspondingly controls the battery 3 to decrease the current transferred to the heating piece 1 according to the temperature decreasing electrical signal transmitted by the temperature adjusting element (21), thereby causing the temperature of the heating piece 1 to reach the temperature desired by the user.

As shown in FIG. 1, the battery 3 can be a dry battery or a lithium battery, which is disposed within the temperature controlling means 2. However, the present invention is not limited thereto. In other embodiments, the battery 3 can also be disposed within a mobile power source as well as electrically connected to the temperature controlling means 2 by way of external connection and supply the power needed by the microprocessor 23 and the heating piece 1. In the present embodiment, the temperature controlling means 2 further includes an external power connecting element 24 so as to be electrically connected to an external power source, which serves to recharge the battery 3. Alternatively, a commercial power source directly supplies power to the temperature controlling means 2 and the heating piece 1 when the battery 3 has insufficient power.

Figure 2:
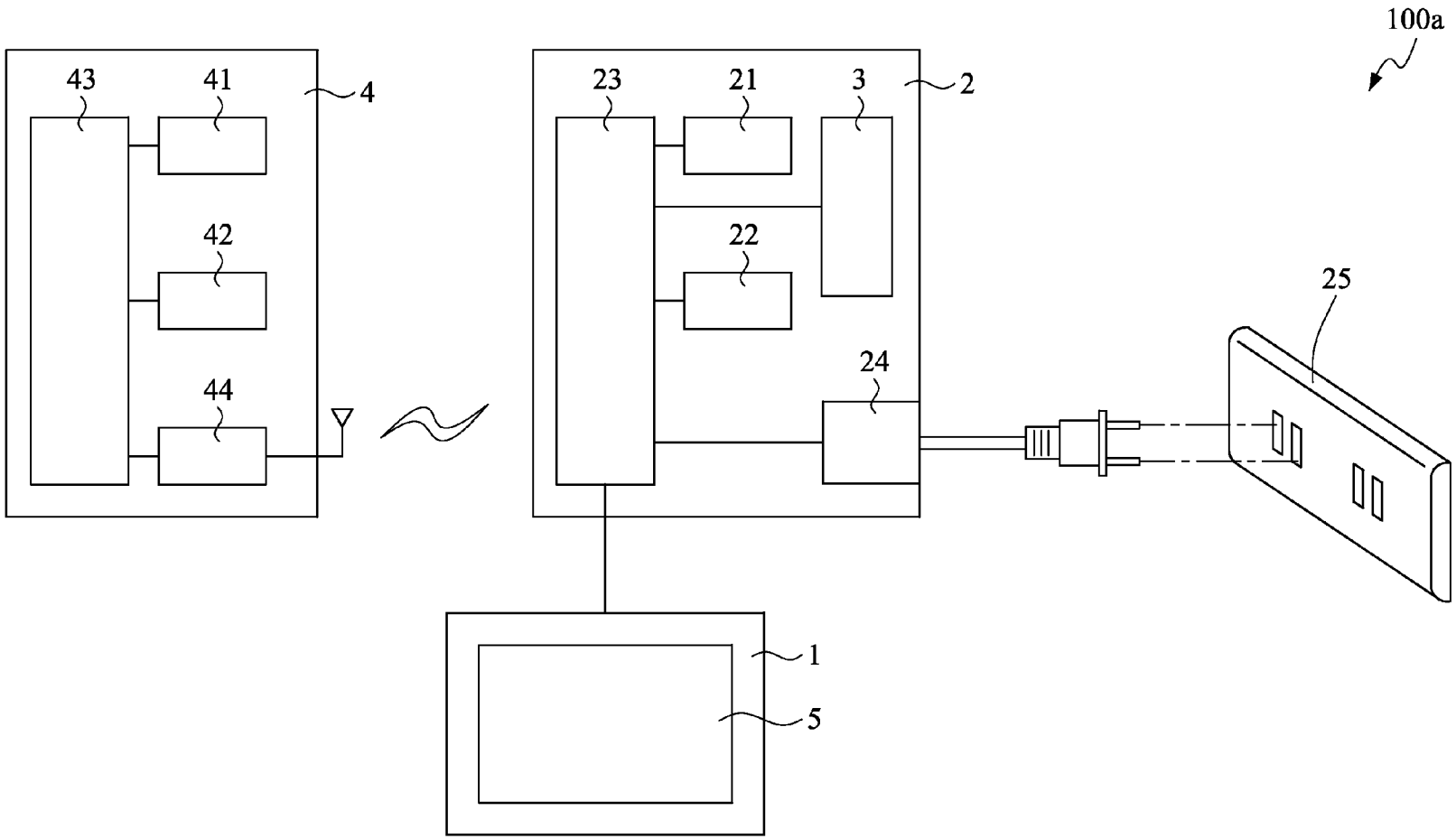
FIG. 2 is a block diagram illustrating a temperature controlling heating device according to a second embodiment of the present invention.
Figure 4:
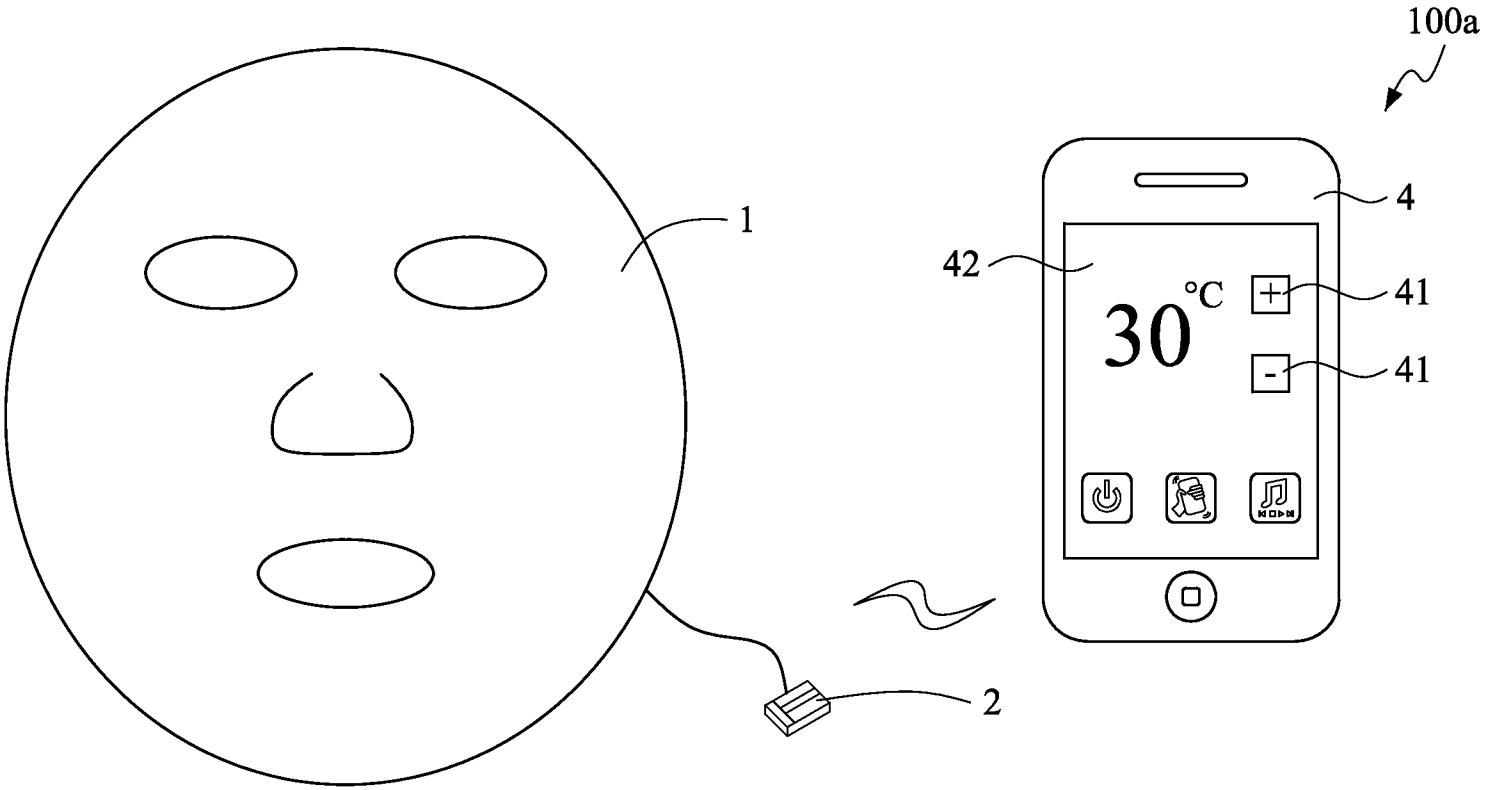
FIG. 4 is a three-dimensional diagram illustrating a heating piece which is a facial mask according to the second embodiment of the present invention.

As shown in FIGS. 2 and 4, a temperature controlling heating device 100*a* according to another embodiment of present invention and the temperature controlling heating device 100 are roughly the same. The difference lie in the fact that the heating piece 1 of the temperature controlling heating device 100*a* is a facial mask, and the temperature controlling device 100*a* further includes an external temperature controlling means 4. The external temperature controlling means 4 is provided with an external temperature adjusting element 41, an external temperature displaying element 42, an external microprocessor 43 and an external wireless controlling transceiver 44. The external temperature adjusting element (41 is disposed on a surface of the external temperature controlling means 4. The external temperature displaying element 42 is disposed on the surface of the external temperature controlling means 4. The external microprocessor 43 is disposed within the external temperature controlling means (4 and electrically connected to the external temperature adjusting element 41 and the external temperature displaying element 42. The external wireless controlling transceiver 44 is disposed within the external temperature controlling means 4 and electrically connected to the external microprocessor 43 and wirelessly connected to the microprocessor 23 of the temperature controlling means 2 to receive or transmit a temperature controlling signal of the external microprocessor 43.

In this embodiment, a user. makes the external processor 43 generate a temperature controlling signal via operation of the external temperature adjusting element 41, and the temperature controlling signal is transmitted to the external wireless controlling transceiver 44. The external wireless controlling transceiver 44 transmits the temperature controlling signal to the microprocessor 23. The microprocessor 23 performs the temperature adjustment of the heating piece 1 via the temperature controlling signal. The external temperature displaying element 42 displays the target temperature.

Figure 3:
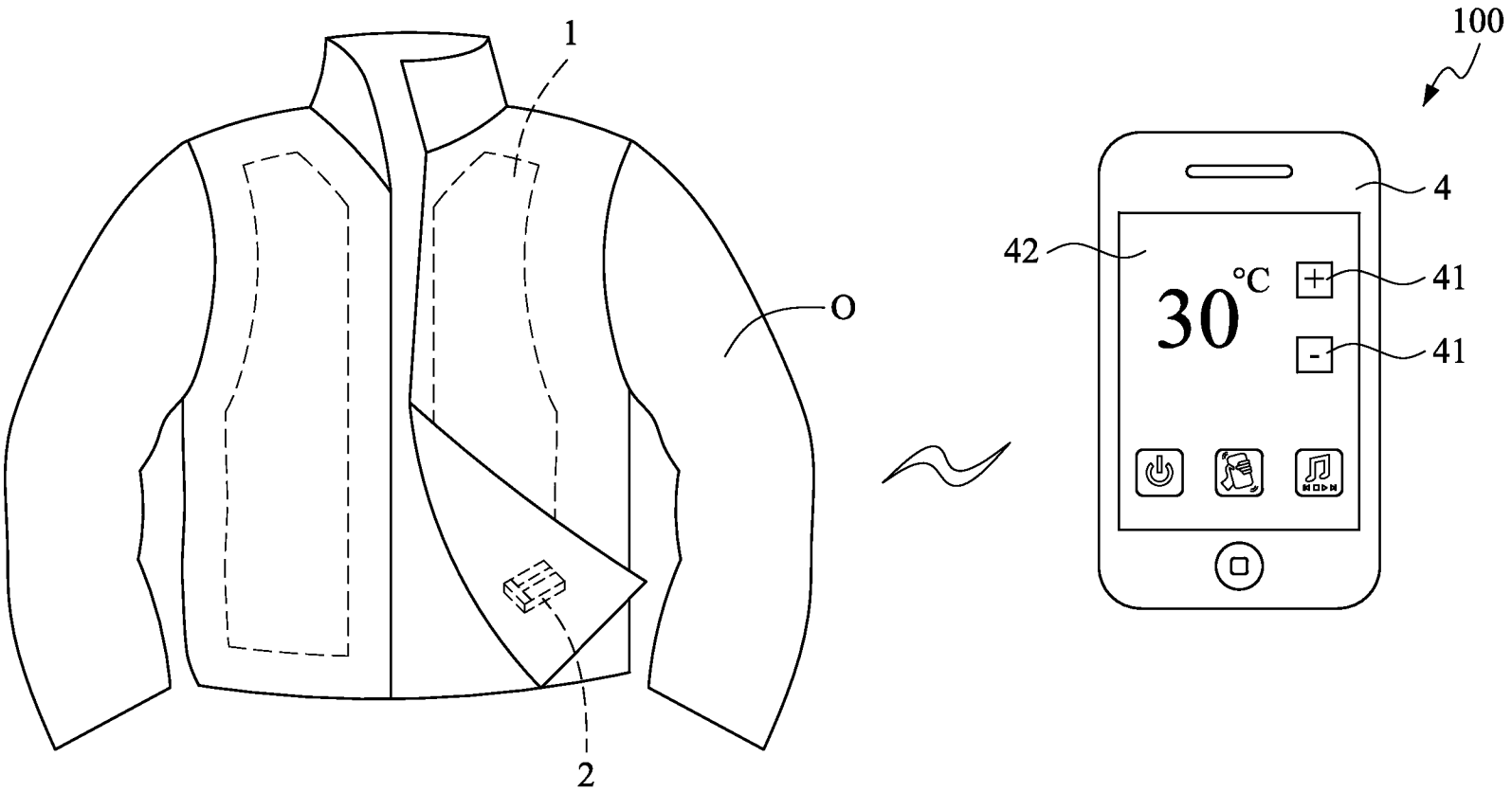
FIG. 3 is a three-dimensional diagram illustrating a heating pieces which is a fabric according to the first embodiment of the present invention.

As shown in FIG. 3, in this embodiment, the external temperature controlling means 4 is a mobile communication device, such as a smart phone. Further, the external temperature adjusting element 41 is a touch control element, such as a touch screen of a smart phone. A temperature controlling signal is generated with the external temperature adjusting element 41 being controlled by a user's touch gestures and transmitted to the microprocessor 23. The microprocessor 23 adjusts the temperature of the heating piece 1 via the temperature controlling signal. The temperature controlling signal can be a Bluetooth signal, a Wi-Fi signal or a radio frequency signal. The temperature controlling means 2 can thereby correspond to the external temperature controlling means 4 by way of wireless transmission.

As shown in FIG. 4, the external temperature adjusting element 41 is an accelerometer, such as a gravity sensor of a smart phone. When a user intends to adjust the temperature of the heating piece 1, he or she first switches the external temperature controlling means 4 to a shaking mode and then raises the temperature of the heating piece 1 via a shaking mode signal generated by shaking the external temperature adjusting element 41. For example, when the external temperature adjusting element 41 detects back-and-forth oscillation of the external temperature controlling means 4, the temperature of the heating piece 1 would be increased. If the external temperature adjusting element 41 senses an up-and-down oscillation of the external temperature controlling means 4) oscillates, the temperature of the heating piece 1 would be decreased. In this way, it is much easier for the user to control the temperature of the heating piece 1.

In addition, as shown in FIGS. 1 and 2, the heating piece 1 can be further provided with a vibrator 5 wirelessly connected to the external wireless controlling transceiver 44 to receive an audio signal generated from the external temperature controlling means 4. The vibrator 5 is disposed at the heating piece 1 and performs a vibratory action according to the audio signal in the first and the second embodiments. In practical operation, a user first switch the external temperature controlling means 4 to an audio vibration mode. The vibrator 5 of the heating piece 1 start vibrating via receipt of the audio signal generated by the external temperature controlling means 4, then achieving the effects of promoting blood circulation and massage.

The above is for describing preferable embodiments of the present invention, but not for limiting the present invention. Therefore, a person skilled in the art may make various modifications to the present invention. Those modifications still fall within the spirit and scope defined by the appended claims.

What is claimed is:

1. A temperature controlling heating device, comprising:

a heating piece;

a temperature controlling means, which is electrically connected to the heating piece, including a temperature adjusting element, a temperature displaying element, a temperature sensor and a microprocessor, wherein the temperature adjusting element and the temperature displaying element are disposed on the same surface of the temperature controlling means, the microprocessor is disposed within the temperature controlling means and is electrically connected to the temperature adjusting element, the temperature displaying element, the temperature sensor and the heating piece, the temperature adjusting element is provided to adjust temperature of the heating piece with the microprocessor in respond to a user's input, the temperature displaying element displays the temperature of the heating piece via the microprocessor; and a battery electrically connected to the temperature controlling means and the heating piece to provide electrical power for the temperature controlling means and the heating piece;

wherein the external temperature controlling means is a mobile communication device, and the external temperature adjusting element is a touch screen; and wherein the external temperature adjusting element is an accelerometer, which is provided for a user to adjust the temperature of the heating piece by shaking the external temperature adjusting element.

2. The temperature controlling heating device as claimed in claim 1, further comprising an external temperature controlling means, including:

an external temperature adjusting element provided at a surface of the external temperature controlling means;

an external temperature displaying element provided at the surface of the external temperature controlling means;

an external microprocessor provided within the external temperature controlling means and electrically connected to the external temperature adjusting element and the external temperature displaying element; and an external wireless controlling transceiver provided within the external temperature controlling means and electrically connected to the external microprocessor and wirelessly connected to the temperature controlling means to receive or transmit a temperature controlling signal of the external microprocessor.

3. The temperature controlling heating device as claimed in claim 1, wherein the battery is a dry battery or a lithium battery.

4. The temperature controlling heating device as claimed in claim 1, wherein the battery is disposed within the temperature controlling means.

5. The temperature controlling heating device as claimed in claim 1, wherein the temperature controlling means further includes an external power connecting element for electrically connecting an external power source.

6. The temperature controlling heating device as claimed in claim 5, wherein the external power source is a commercial power source.

7. The temperature controlling heating device as claimed in claim 2, wherein the temperature controlling signal is a Bluetooth signal, a Wi-Fi signal or a radio frequency signal.

8. The temperature controlling heating device as claimed in claim 1, wherein the heating piece is further provided with a vibrator, the vibrator is disposed at the heating piece and wirelessly connected to the external wireless controlling transceiver to receive an audio signal from the external temperature controlling mean, and the vibrator performs a vibration according to the audio signal.

9. A temperature controlling heating device, comprising:

a heating piece;

a temperature controlling means, which is electrically connected to the heating piece, including a temperature adjusting element, a temperature displaying element, a temperature sensor and a microprocessor, wherein the temperature adjusting element and the temperature displaying element are disposed on the same surface of the temperature controlling means, the microprocessor is disposed within the temperature controlling means and is electrically connected to the temperature adjusting element, the temperature displaying element, the temperature sensor and the heating piece, the temperature adjusting element is provided to adjust temperature of the heating piece with the microprocessor in respond to a user's input, the temperature displaying element displays the temperature of the heating piece via the microprocessor; and a battery electrically connected to the temperature controlling means and the heating piece to provide electrical power for the temperature controlling means and the heating piece;

wherein the external temperature controlling means is a mobile communication device, and the external temperature adjusting element is a touch screen; and wherein the heating piece is further provided with a vibrator, the vibrator is disposed at the heating piece and wirelessly connected to the external wireless controlling transceiver to receive an audio signal from the external temperature controlling mean, and the vibrator performs a vibration according to the audio signal.

* * * * *